US011065750B2

(12) United States Patent
Cordeiro et al.

(10) Patent No.: US 11,065,750 B2
(45) Date of Patent: Jul. 20, 2021

(54) FOR A GAS-POWERED FIXING TOOL

(71) Applicant: Illinois Tool Works Inc., Glenview, IL (US)

(72) Inventors: Pierre Cordeiro, Livron sur Drome (FR); Patrick Herelier, Saint Jean de Muzols (FR); Frédéric Nayrac, Bourg les Valence (FR); Christian Ricordi, Châteauneuf-sur-lsère (FR); Alain Vettoretti, Bourg les Valence (FR)

(73) Assignee: Illinois Tool Works Inc., Glenview, IL (US)

( * ) Notice: Subject to any disclaimer, the term of this patent is extended or adjusted under 35 U.S.C. 154(b) by 347 days.

(21) Appl. No.: 15/553,112

(22) PCT Filed: Feb. 29, 2016

(86) PCT No.: PCT/US2016/020000
§ 371 (c)(1),
(2) Date: Aug. 23, 2017

(87) PCT Pub. No.: WO2016/144580
PCT Pub. Date: Sep. 15, 2016

(65) Prior Publication Data

US 2018/0036871 A1 Feb. 8, 2018

(30) Foreign Application Priority Data

Mar. 10, 2015 (EP) ..... 15158537
Dec. 18, 2015 (EP) ..... 15200997

(51) Int. Cl.
*B25C 1/08* (2006.01)

(52) U.S. Cl.
CPC ..... *B25C 1/08* (2013.01)

(58) Field of Classification Search
CPC ..... B25C 1/08
(Continued)

(56) References Cited

U.S. PATENT DOCUMENTS 6,491,015 B1 12/2002 Thieleke et al.
6,647,969 B1 11/2003 Adams
(Continued)

FOREIGN PATENT DOCUMENTS

EP 0 123 717 4/1988
EP 1 254 745 11/2002
(Continued)

OTHER PUBLICATIONS

International Search Report and Written Opinion for International Application No. PCT/US2016/02000 dated Aug. 8, 2016 (15 pages).
(Continued)

*Primary Examiner* — Anna K Kinsaul
*Assistant Examiner* — Veronica Martin
(74) *Attorney, Agent, or Firm* — Neal, Gerber & Eisenberg LLP

(57) ABSTRACT

The present disclosure concerns improvements for a gas-powered fixing tool, and particularly a combustion chamber or precombustion chamber for a gas-powered fixing tool, a working chamber for a gas-powered fixing tool, a fuel gas injection device for a gas-powered fixing tool and a gas-powered fixing tool including one or more of these elements.

12 Claims, 7 Drawing Sheets

(58) Field of Classification Search
USPC ..... 227/9, 10; 123/281
See application file for complete search history.

(56) References Cited

U.S. PATENT DOCUMENTS

| | | | | |
|---|---|---|---|---|
| 6,877,308 | B2 | 4/2005 | Voelker et al. | |
| 6,983,871 | B2 | 1/2006 | Shima et al. | |
| 7,520,252 | B2 * | 4/2009 | Toulouse | B25C 1/08 123/46 A |
| 8,313,545 | B2 | 11/2012 | Panasik et al. | |
| 8,347,832 | B2 | 1/2013 | Adams | |
| 2002/0134345 | A1 * | 9/2002 | Adams | B25C 1/08 123/285 |
| 2006/0226193 | A1 * | 10/2006 | Toulouse | B25C 1/08 227/10 |
| 2014/0014703 | A1 | 1/2014 | Kestner et al. | |
| 2017/0203425 | A1 * | 7/2017 | Herelier | B25C 1/08 |

FOREIGN PATENT DOCUMENTS

| | | | | |
|---|---|---|---|---|
| EP | 1 371 457 | | 12/2003 | |
| EP | 1371457 | A2 * | 12/2003 | B25C 1/08 |
| EP | 1 375 074 | | 1/2004 | |
| EP | 1 484 138 | | 12/2004 | |
| EP | 1 980 367 | | 10/2008 | |
| EP | 1 243 383 | | 5/2009 | |
| EP | 2 202 033 | | 6/2010 | |
| EP | 2 087 220 | | 10/2011 | |

OTHER PUBLICATIONS

Australian Examination Report No. 1 for Australian Application No. 201622942, dated May 22, 2018 (4 pages).
New Zealand First Examination Report for New Zealand Application No. 734353, dated Mar. 19, 2018 (6 pages).

* cited by examiner

FOR A GAS-POWERED FIXING TOOL

PRIORITY CLAIM

This patent application is a national stage entry of PCT Application No. PCT/US2016/020000, which was filed on Feb. 29, 2016, which claims priority to and the benefit of European Patent Application No. 15200997.3, which was filed on Dec. 18, 2015 and European Patent Application No. 15158537.9, which was filed on Mar. 10, 2015, the entire contents of each of which are incorporated herein by reference.

TECHNICAL FIELD

The present disclosure concerns improvements for a gas-powered fixing tool and a gas-powered fixing tool including at least one of those improvements.

BACKGROUND

The prior art includes in particular the documents EP-B1-123 717, EP-B1-1 243 383 and EP-B1-2 087 220.

Certain so-called gas-powered fastening or fixing tools typically comprise an internal combustion engine operating by igniting an air-fuel mixture in a combustion chamber, fuel from a fuel cartridge being injected into the chamber by an injection device. Such tools are intended to drive fixing elements into support materials (such as wood, concrete or steel) to fix components thereto. Gas-powered tools are in very widespread use nowadays and make it possible to install fixing elements of staple, nail, spike, pin, etc. type. By way of internal combustion engine fuel there may be cited petrol, alcohol, in liquid and/or gas form, for example.

Such a tool is generally portable and includes a casing in which the internal combustion engine propelling a piston driving a fixing element is mounted. Such a tool may also include a battery for supplying electrical power and a handle for holding, manipulating and firing it on which a trigger for actuating the tool is mounted.

The present disclosure aims to improve this technology.

SUMMARY OF THE INVENTION

In accordance with a first aspect, the present disclosure concerns a combustion or precombustion chamber for a gas-powered fixing tool, comprising a casing defining a combustion cavity having a generally elongate form of longitudinal axis X, characterized in that said cavity has a variable cross section along said axis X.

The present disclosure can therefore make it possible to reduce the overall size of the chamber, for example to reduce its length. This length reduction can reduce the travel time necessary for the flame to cross the chamber longitudinally, which commensurately reduces the duration of a firing cycle by the tool. The present disclosure can further make it possible to optimize the spatial distribution of the mass of the chamber within the tool, for example in order to shift the center of gravity of the tool into a predetermined area.

The chamber in accordance with the present disclosure may have one or more of the following features, considered separately from one another or in combination with one another:

said cavity has a generally staged form and comprises at least one first portion of cross section S1 and one second portion of cross section S2, with S1 different from S2, the ratio S2/S1 is between 1.1. and 3.0 inclusive, for example, or even greater; in one particular case, it may be between 1.1 and 1.5 inclusive, and preferably between 1.2 and 1.5 inclusive, ignition mechanism, such as a spark plug, is situated at a longitudinal end of said cavity, said ignition mechanism is situated in a portion of smaller cross section of said cavity, said cavity comprises a longitudinal end opposite said ignition mechanism, which is fluidically connected with a second combustion cavity, said cavity has, in longitudinal section, a generally L or T-shaped form.

In accordance with a second aspect, the present disclosure concerns a combustion or precombustion chamber for a gas-powered fixing tool, comprising a casing defining a combustion cavity, characterized in that said cavity has at least partly a spherical or ovoid form.

In accordance with a second aspect, the present disclosure concerns a combustion or precombustion chamber for a gas-powered fixing tool, comprising a casing defining a combustion cavity, characterized in that said cavity has at least partly a spherical or ovoid form.

In such embodiments, the present disclosure is advantageous because it makes it possible to reduce sharp edges and intersections inside the cavity, the inventors having realized that these elements create combustion and flow dead areas that reduce the efficiency of combustion and filling (and purging) and therefore the performance of the tool.

The chamber in accordance with the present disclosure may have one or more of the following features, considered separately from one another or in combination with one another:

said casing defines three openings, two of which are aligned on a same axis U and a third of which is aligned on an axis Y substantially at right angles to the axis U, said casing comprises a first half-shell comprising a first wall in the form of a portion of sphere, said first wall is a median wall which is situated between two end walls each in the form of a portion of cylinder, said end walls partly define said openings of axis U, said casing comprises a second half-shell comprising two end walls each in the form of a portion of cylinder and partly defining said openings of axis U, and a cylindrical wall defining said opening of axis Y.

In accordance with a third aspect, the present disclosure concerns a working chamber for a gas-powered fixing tool, comprising a casing defining a housing in which a piston is mounted and can slide to drive a fixing element, said piston being configured to be translationally displaced in said housing from a rest position to a working position, the chamber further comprising a dynamic sealing mechanism between said piston and said casing to ensure a seal during said displacement, characterized in that it further comprises a static sealing mechanism between said piston and said casing to ensure a seal when said piston is in its rest position, said static sealing mechanism being independent of said dynamic sealing mechanism.

The sealing mechanism therefore has distinct functions. In addition to the known dynamic sealing mechanism, the chamber is equipped with a static sealing mechanism, that is to say a mechanism configured to establish a seal between the piston and the casing of the chamber outside of any relative movement between them. This seal is established when the piston is in its rest position, which makes it possible to close the combustion chamber in a sealed manner, which chamber communicates with the internal cavity in which the piston moves, and to optimize the combustion of the air-fuel mixture in the combustion chamber.

The chamber in accordance with the present disclosure may have one or more of the following features, considered separately from one another or in combination with one another:

- the dynamic sealing mechanism is configured to be operational/functional (to cooperate with a sealing surface for example) when the piston is in its rest and working positions, and the static sealing mechanism is configured to be operational/functional when the piston is in its rest position and not to be so when it is in its working position,
- said static sealing mechanism is borne by said casing,
- said static sealing mechanism is borne by said piston,
- said dynamic sealing mechanism is borne by said piston,
- said piston comprises a first outer cylindrical surface comprising an annular groove housing a dynamic seal,
- said piston comprises a second inner or outer cylindrical surface comprising an annular groove housing a static seal,
- said piston has an elongate form and comprises a head and a rod that are coaxial, and in which said second surface is situated at a longitudinal end of said head, which is opposite said rod.

In accordance with a fourth aspect, the present disclosure concerns a device for injecting a fuel gas for a gas-powered fixing tool, characterized in that it comprises an evaporator block comprising:

- a fuel evaporation cavity,
- a fuel evaporation duct outgoing from said cavity, and
  - a housing, preferably upstream of said cavity, in which is mounted a substantially planar (for example slightly curved) filter configured to retain impurities of said fuel.

The complex evaporation mechanisms of the prior art are replaced by a plane filter and evaporation spaces, which makes it possible to simplify the evaporator block and to reduce the cost thereof.

The device in accordance with the present disclosure may have one or more of the following features, considered separately from one another or in combination with one another:

- said evaporator block comprises a housing for receiving a member for actuating a fuel cartridge, said member having an elongate form of axis Z and being configured to be translationally displaced along said axis between a rest position and a position for releasing fuel from said cartridge, said member comprising an internal bore for the passage of fuel which comprises a generally L or T-shaped form of which a first axial part emerges at a longitudinal end of said member and of which a second radial part emerges on an outer peripheral surface of said member and is intended to be situated facing said filter at least when said member is in said release position,
- said duct has a generally L or S-shaped form,
  - said duct is formed of a single piece with at least a part of said evaporator block.

The present disclosure further concerns a gas-powered fixing tool comprising a chamber or a plurality of chambers as described above and/or a device as defined above.

BRIEF DESCRIPTION OF THE FIGURES

The invention will be better understood and other details, features and advantages of the present invention will become more clearly apparent on reading the following description given by way of nonlimiting example and with reference to the appended drawings, in which.

DETAILED DESCRIPTION

Figure 1:
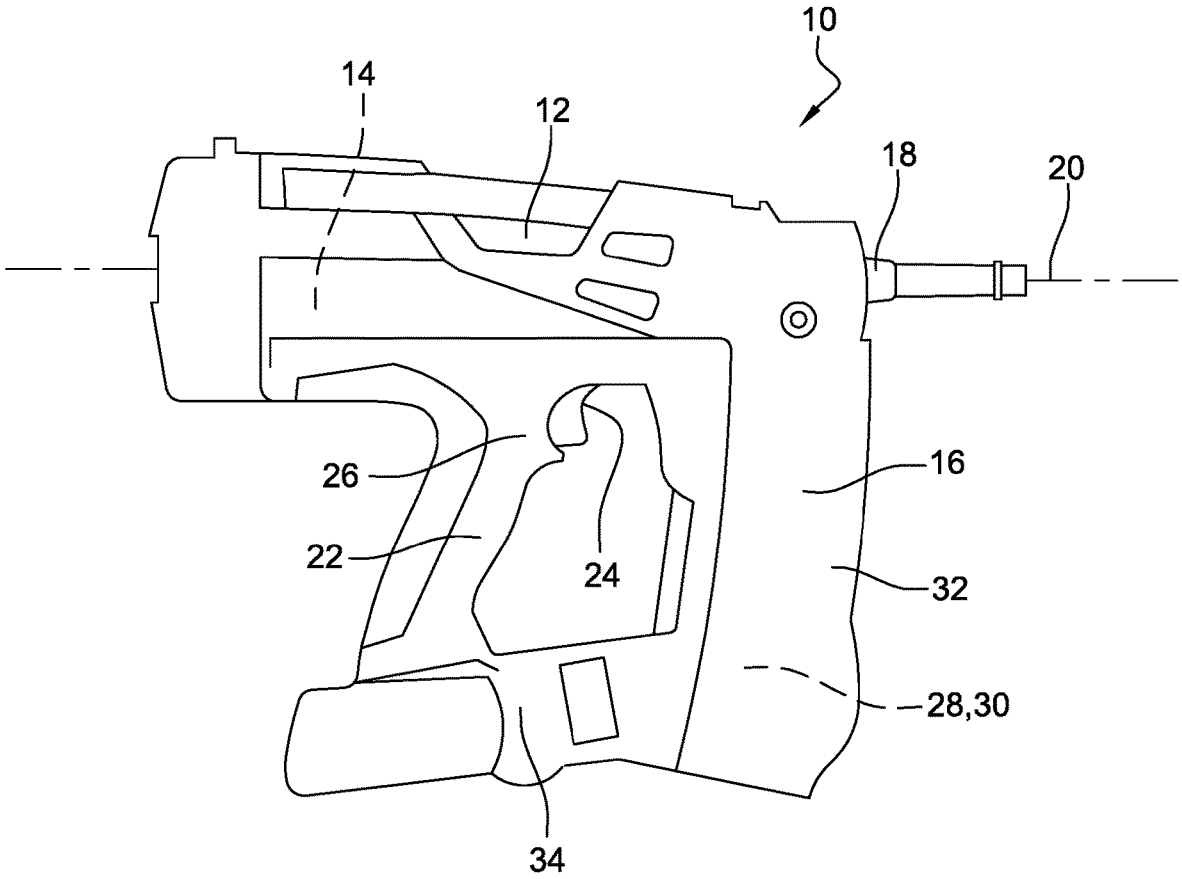
FIG. 1 is a diagrammatic view of a gas-powered fixing tool in accordance with one example embodiment of the present disclosure.

Referring now to the drawings, one example illustrated tool 10 of the present disclosure is shown in FIG. 1 and includes a casing 12 in which is located an internal combustion engine 14 with a combustion chamber intended to contain a mixture of air and fuel the ignition of which causes the propulsion of a piston provided to drive a fixing element extracted from a feed magazine 16. The fixing element is intended to be anchored into a support material on leaving a spike guide 18 at the front of the casing 12. All these components of gas-powered fixing tools are familiar to the person skilled in the art and therefore do not all need to be shown in the drawings.

The casing of the tool has an axis 20 along which the drive piston and the fixing elements move, the latter inside the spike guide 18.

The tool 10 includes a handle 22 for holding and manipulating the tool. It extends, from the casing and externally thereof, substantially perpendicularly to the axis 20, being slightly inclined to it depending on the application of the tool and the ergonomics of its use. The handle 22 is also used to fire it by way of an actuating trigger 24 mounted on it in the area 26 in which it is connected to the casing 12.

The combustion chamber of the engine 14 is fed with fuel from a fuel gas cartridge 30 via an injection device 28.

The injection device 28 and the cartridge 30 are advantageously housed in an arm 32 connected to the casing 12 that is substantially perpendicular to the axis 20 in front of the handle 22 and in which the magazine 16 is also located.

Another arm 34 substantially parallel to the axis 20 extends between the handle 22 and the arm 32 so as to form a bridge between them on the (lower) side opposite the casing 12.

There will now be described the various aspects of the present disclosure that may be incorporated in the tool 10 from FIG. 1 independently of one another or in combination with one another.

Injection Device

Figure 2:
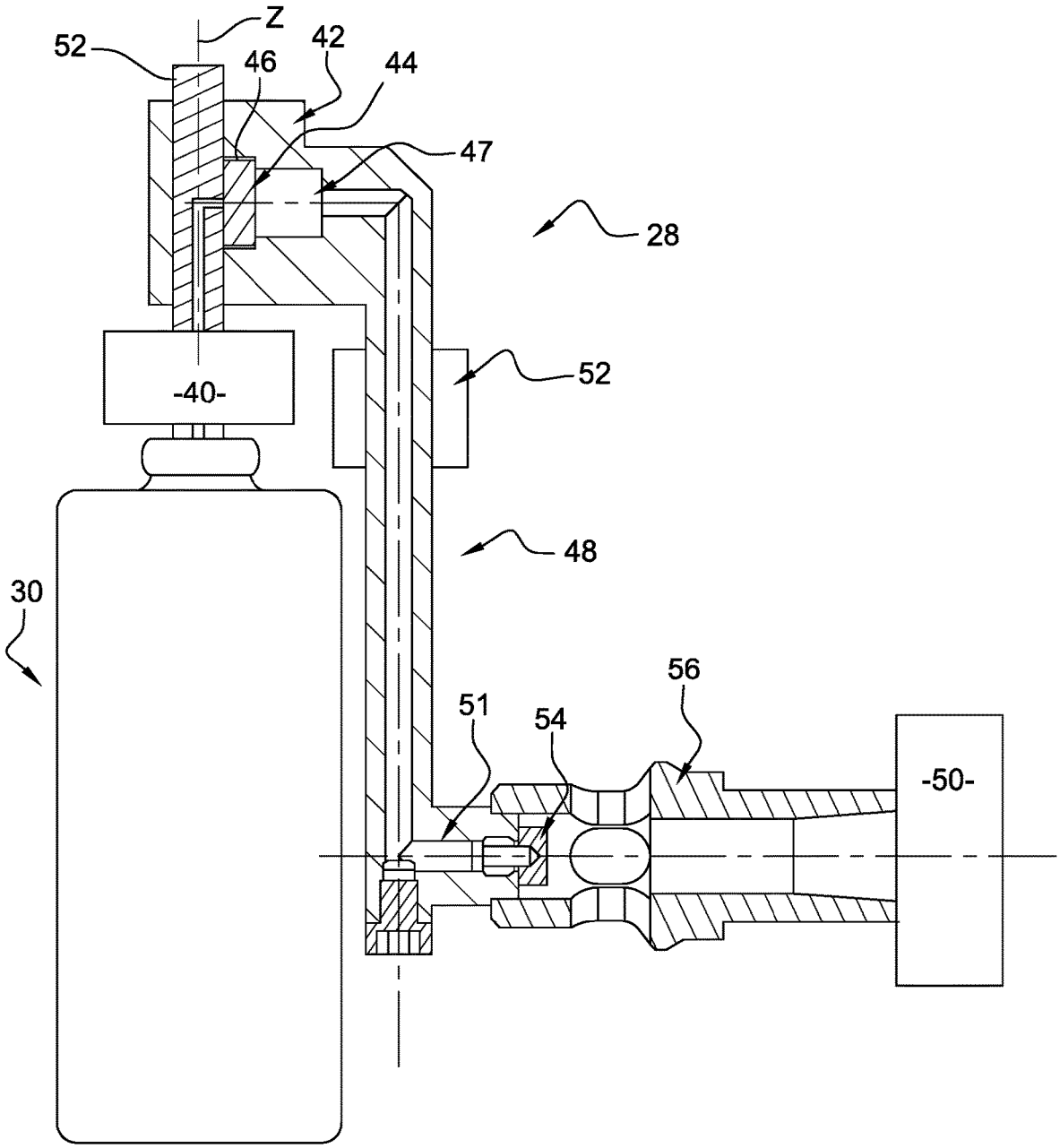
FIG. 2 is a diagrammatic view of a fuel gas injection device in accordance with one example embodiment of the present disclosure.

One aspect of the present disclosure illustrated by FIG. 2 concerns the device 28 for injecting fuel into the engine from a fuel cartridge 30.

The fuel is in the liquid state in the cartridge and must be evaporated, the fuel gas being intended to be mixed with air before being burned in the combustion chamber of the internal combustion engine.

An injection device of a gas-powered fixing tool must therefore make it possible to evaporate the fuel.

The document EP-B1-2 087 220 describes a system for feeding and evaporating liquid fuel to convert a liquid fuel into a gaseous fuel. That system includes an evaporator element associated with a casing that is heated in order to heat the evaporator element. The evaporator element is made from sintered metal and has a conical or frustoconical general shape.

This technology is complex and relatively bulky, notably because of the particular shape of the evaporator element. This technology is also relatively costly.

Moreover, this known evaporator element is relatively fragile and has a low resistance to the vibrations and shocks generated during the operation of a fixing tool. Additionally, as the fuel used to operate these tools may contain lubricants, additives and even impurities, the evaporator element may become clogged, therefore blocking the passage of the fuel through it. The result of this situation is malfunctioning of the tool, which necessitates demounting and cleaning of the evaporator element and possibly its replacement, because the cleaning operation may damage this element.

The present disclosure is able to solve all the problems mentioned above. As well as attempting to manage the clogging of the evaporator element, the inventors have proposed a filter element notably having the aim of trapping the various materials contained in the fuel leaving the cartridge.

Various filters have been tested. The filters essentially include a screen, a mesh, a grid, a fabric, a woven material, a foam or fibers. These filters are made of metal or plastic or from mineral or natural fibers. The aim of these filters is to trap particles contained in the fuel whilst enabling the fuel to pass through the filter.

With the aim of simplifying the prior art injection device, the evaporator element is dispensed with. Surprisingly, the use of a filter disposed in the simplified injection device combined with an evaporation cavity makes possible optimum vaporization of the fuel in order to feed the combustion chamber of the tool.

FIG. 2 represents one example embodiment of the injection device 28.

A valve 40 intended to measure out a quantity of liquid fuel is disposed between the liquid fuel cartridge 30 and the simplified evaporator block 42. A filter 44 is disposed in a housing or bore 46 in the block 42. A predetermined quantity of liquid fuel is discharged from the cartridge 30 via the valve 40 into the block 42, passing through the filter 44, and arrives in the evaporation cavity 47. The block 42 is made from a thermally conductive material, such as metal. The liquid fuel passing through the filter 44 is at least partly converted into gaseous fuel thanks to the input of heat from the surrounding environment, which transmits thermal energy to the evaporator block 42.

Downstream of the filter 44 and the cavity 47, the at least partially vaporized fuel continues to circulate in the block 42 and absorbs additional heat from the environment. The downstream part of the block 42 includes an evaporation duct 48 acting as a distribution manifold leading to the combustion chamber 50 of the fixing tool.

The dimensional parameters of the device 28, and in particular of the cavity 47 and of the duct 48, such as the width, the diameter, the thickness, etc., are chosen so that the fuel is entirely converted into gas when it exits a downstream discharge port 51 of the duct 48. The block 42 and/or the duct 48 may comprise one or more fins 52 disposed on at least one of their surfaces to assist the transfer of heat from the surrounding environment.

On leaving the discharge port 51, the gaseous fuel can be injected directly into the combustion chamber 50. An option is for the gaseous fuel leaving the discharge port 51 to feed one or more fuel outlet nozzles 54 feeding the combustion chamber 50. The fuel gas may alternatively feed a Venturi-type jet pump 56 in which surrounding air is drawn into the jet pump 56 and mixed with the gaseous fuel injected via the nozzle or nozzles 54 so as to form an air-fuel mixture for feeding the combustion chamber 50.

This evaporator block 42 is therefore easier to manufacture at lower cost. The filter is plane and therefore relatively simple. It lies substantially in a plane parallel to the axis Z of the cartridge 30. It has the shape of a pastille, disk or block, for example. It is much simpler and less fragile than the complex parts used in the prior art. Consequently, the simplified evaporator block is also easier to maintain when necessary, although the necessity to maintain such a block is also significantly reduced.

Figure 3:
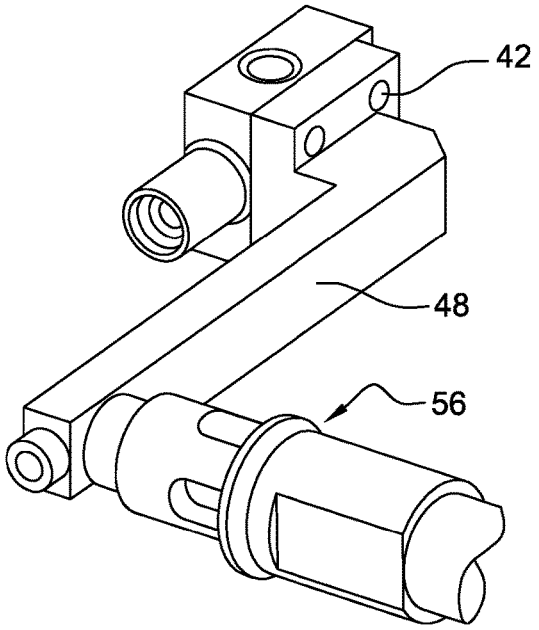
FIG. 3 is a diagrammatic perspective view of the device from FIG. 2, FIGS. 4*a* and 4*b* are diagrammatic views corresponding to FIG. 2 and showing two respective positions of an actuating member of the device.

FIG. 3 is a diagrammatic perspective view of the device 28 from FIG. 2 and notably shows that the duct 48 is formed in one piece with a portion of the evaporator block 42.

As seen in FIG. 2, the duct 48 has the general shape of an S or an L. The cavity 47 has a section in the shape of a T of which the upstream portion with the greatest transverse dimension forms the housing 46 receiving the filter. The cavity 47 communicates with a rectilinear end portion of the duct 48. The duct includes another rectilinear end portion that defines the discharge port 51. These two portions are parallel and connected to each other by a rectilinear median portion of the duct substantially parallel to the longitudinal axis Z of the cartridge 30. This rectilinear portion may be shut off in a sealed manner by a screw at the level of its connection to the rectilinear end portion that defines the discharge port 51.

The evaporator block 42 includes a bore in which an actuator member 58 is mounted and able to slide along the longitudinal axis Z of the cartridge 30. This actuator member has an elongate rectilinear shape and includes an internal bore 60 in the shape of a T or an L. This bore includes a first axial section that extends along the member 58 and discharges at the lower end thereof and a radial portion that extends between the upper end of the axial portion and the periphery of the member. The outlet of this radial portion is situated facing the filter 44.

Figure 4A:
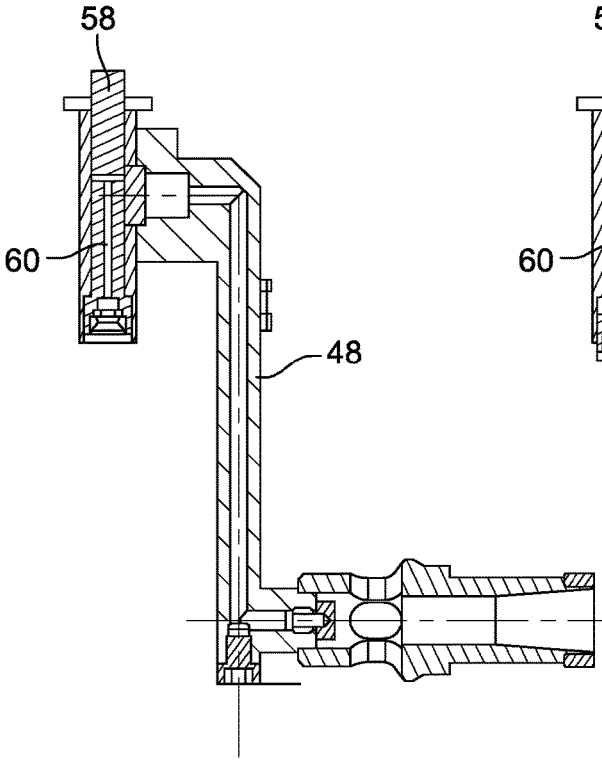
Figure 4B:
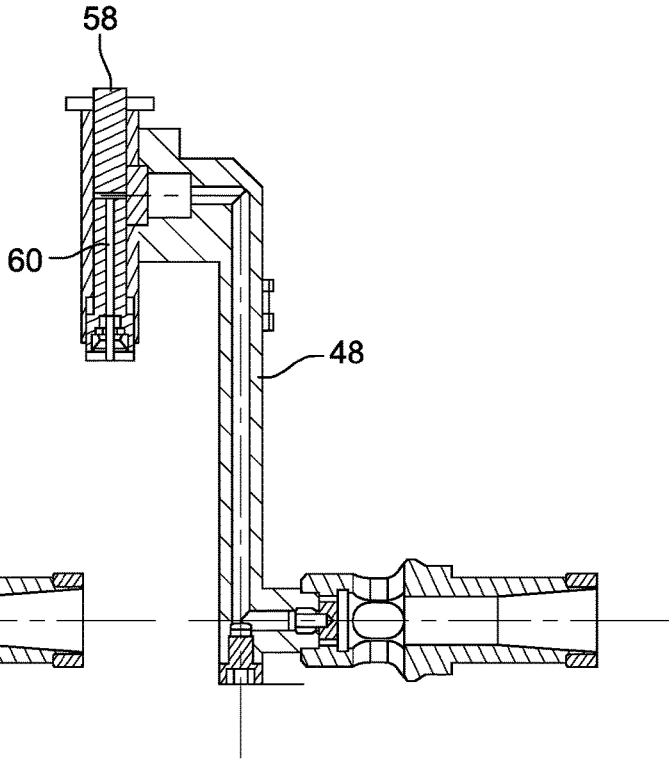

The member 58 is mobile between two positions: a high or rest position shown in FIG. 4*a* and a low or working position shown in FIG. 4*b*. In both cases, the aforementioned radial outlet of the bore is situated facing the filter 44. Seals are provided between the member 58 and the bore in which it is mounted.

The lower end of the member 58 is configured to cooperate through mutual nesting with a connection end-piece of the cartridge 30.

The movement of the member 58 from its rest position to its working position causes the release of a calibrated quantity of fuel from the cartridge 30. This fuel, in liquid form, flows in the bore 60 of the member 58 and passes through the filter 44, which retains any impurities, before penetrating into the cavity 47 in which the transformation of the liquid fuel into gaseous fuel is initiated. The fuel flows in the duct 48 to complete its evaporation and reaches the gaseous state at the level of the nozzle 54. It is then atomized in the jet pump 56 and mixed with air that penetrates into the pump by virtue of the Venturi effect, the air-fuel mixture then being injected into the chamber 50 of the internal combustion engine.

As shown in FIG. 2, the block 42 is advantageously situated above the cartridge 30, the duct 48 advantageously extends in part on one side of the cartridge, and the jet pump 56 advantageously has a substantially perpendicular orientation relative to the longitudinal axis Z of the cartridge or to the duct 48. The cartridge 30, the block 42 and the duct 48 are advantageously housed in the arm 32 and the jet pump ideally lies in the arm 34, the combustion chamber 50 then being housed in the handle 22 of the tool from FIG. 1.

The filter 44 has a permeability less than 50 darcy and preferably between 10 and 33 darcy inclusive, for example, which makes it possible to filter particles with a diameter between approximately 7 μm and 14 μm inclusive with an efficiency of 98 to 99.9%.

Precombustion Chamber

An internal combustion engine of a gas-fired fixing tool includes a combustion chamber and a working chamber in which a piston driving a fixing element is able to move because of the effect of the explosion of the air-fuel mixture in the combustion chamber.

Figure 5:
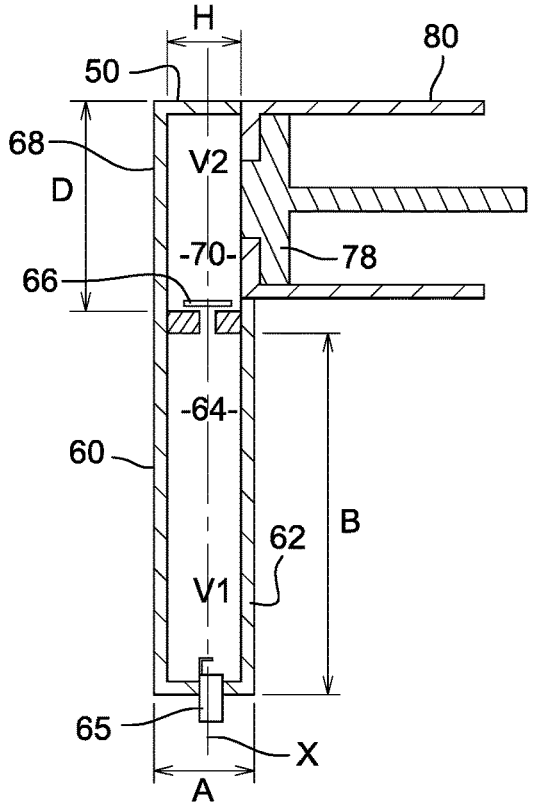
FIG. 5 is a diagrammatic view in axial section of chambers of a prior art gas-powered fixing tool.

As shown in FIG. 5, which represents the prior art described in the document EP-B1-1 243 383, the engine advantageously includes a precombustion chamber 60 and a combustion chamber 50. The first combustion chamber or precombustion chamber 60 makes it possible to initiate the combustion of the air-fuel mixture. This chamber 60 includes a casing 62 that defines a combustion cavity 64 in which is mounted an ignition mechanism such as a sparkplug 65.

The chambers 60 and 50 are separated from each other by a valve 66. The precombustion of the mixture in the chamber 60 causes an increase in pressure in the cavity 64. When this pressure exceeds a certain threshold, the valve opens and enables the combustible mixture to pass into the chamber 50.

The chamber 50 includes a casing 68 defining a combustion cavity 70. The mixture arrives in the chamber 50 at a relatively high pressure. The flame coming from the chamber 60 reaches the chamber 50, the high-pressure combustion in the chamber 50 making it possible to improve the performance of the tool. The combustion in the chamber 50 causes an increase of pressure in the cavity 70 that forces the piston 78 to move in the working chamber 80.

As can be seen in FIG. 5, it is known to provide a precombustion chamber 60 of elongate shape, one longitudinal end of which is connected to the combustion chamber 50 and the opposite longitudinal end of which includes the sparkplug 64.

The output power of the combustion chamber 50 can be increased by up to fifty percent (50%) merely by lengthening the precombustion chamber 60.

In the document EP-B1-1 243 383, the precombustion chamber 60 has a predetermined length B and a predetermined width A, where the length B is significantly greater than the width A. To be more specific, the ratio of the length B to the width A, known as the aspect ratio of the precombustion chamber 60, is at least 2:1, and can be much higher with an optimum around 10:1 according to the same document.

It is also indicated in the document EP-B1-1 243 383 that discontinuities or irregularities present in or on the internal surfaces of the precombustion chamber must be avoided because such structures tend to reduce the power of the engine. Moreover, a precombustion chamber can have a round, oval, rectangular or other shape in cross section provided that its length is greater than its width.

Thus the prior art precombustion chamber 60 has a length B that is detrimental to the overall size of the tool.

Another disadvantage of this precombustion chamber 60 is that the longer the precombustion chamber, the greater the delay between igniting the spark and igniting the combustion chamber 50. This can increase the duration of the firing cycle of the tool, which is a problem in some fixing applications.

Finally, the configuration of the precombustion chamber 60 is not the optimum in terms of ergonomics.

The following improvements make it possible to optimize the overall size of the tool, to optimize its operation and/or to shorten the duration of a firing cycle and in particular the duration between ignition in the precombustion chamber 60 and combustion in the chamber 50, at the same time as maintaining good combustion chamber performance.

To be in a position to compare the effect of the new precombustion chamber configuration against the prior art, the inventors have maintained the total volume of the chambers 50 and 60 constant. The total quantities of air-fuel mixture are therefore comparable and consequently the same total quantities of raw energy are available.

V1 denotes the volume of the precombustion chamber 60 and V2 denotes the principal volume of the combustion chamber 50. V1+V2 is constant for all the tests. Moreover, as the object of the present disclosure is to improve the performance of the precombustion chamber 60, the inventors have kept V1 the same for all the embodiments.

The inventors have noted that, by keeping V1 constant, a beneficial effect is achieved by changing the configuration of the precombustion chamber 60 from an elongate shape of constant cross section to an elongate shape in which the cross section varies along the longitudinal axis of the chamber. It can have a cross section that is staggered or has a frustoconical shape.

This means that the precombustion chamber preferably has, starting from the sparkplug 65, in the direction of the combustion chamber 50, an increasing section. The precombustion chamber 60 preferably includes two portions, the first portion including the sparkplug 65 and having a maximum first inside diameter that is smaller than the minimum inside diameter of the second portion.

Figure 6:
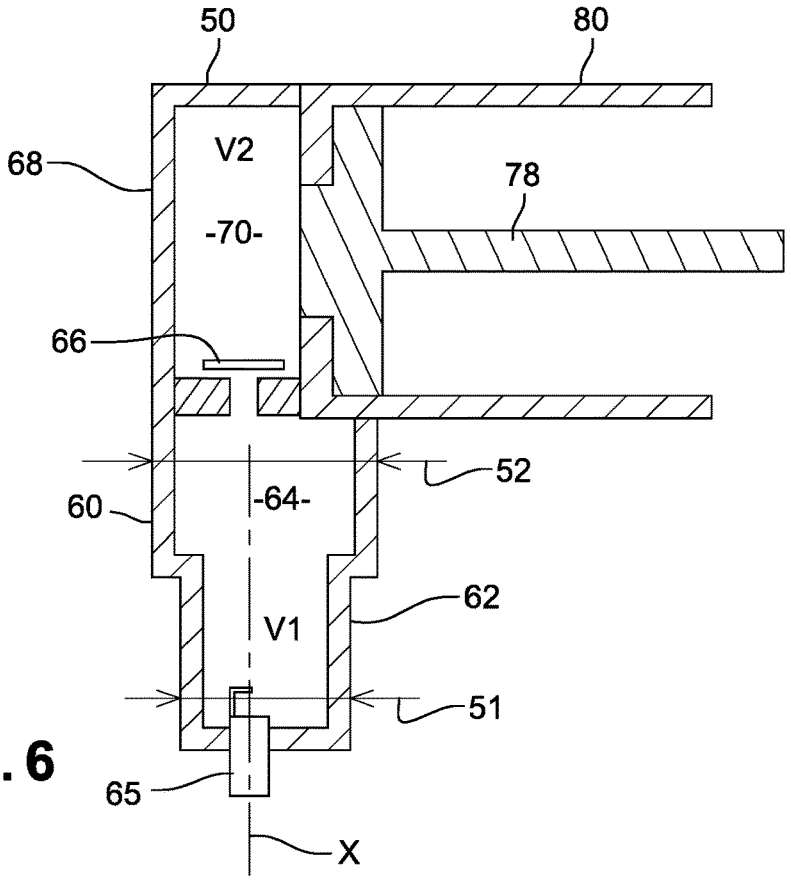
FIGS. 6, 7 and 8 are diagrammatic views in axial section of chambers of a gas-powered fixing tool in accordance with one example embodiment of the present disclosure.

At least one diameter, and preferably both diameters of the first and second portions, is or are preferably constant. For example, as shown in FIG. 6, the elongate chamber of constant cross section is replaced by two portions of which an upper one has a cross section S2 greater than that S1 of the other, lower portion. The chamber 60 therefore has in longitudinal section the general shape of a T. Consequently, whilst maintaining the volume V1 constant, this embodiment has a length less than the prior art length B. Consequently, the overall size of the tool may be reduced.

The reduction of the length of the precombustion chamber 60 makes it possible to reduce the distance between the sparkplug 65 and the combustion chamber 50, which has the advantage of reducing the time to ignite the chamber 50 and the overall duration of a firing cycle.

The present disclosure therefore provides an efficient precombustion chamber for a tool that is less bulky and can operate faster than those of the prior art.

Figure 7:
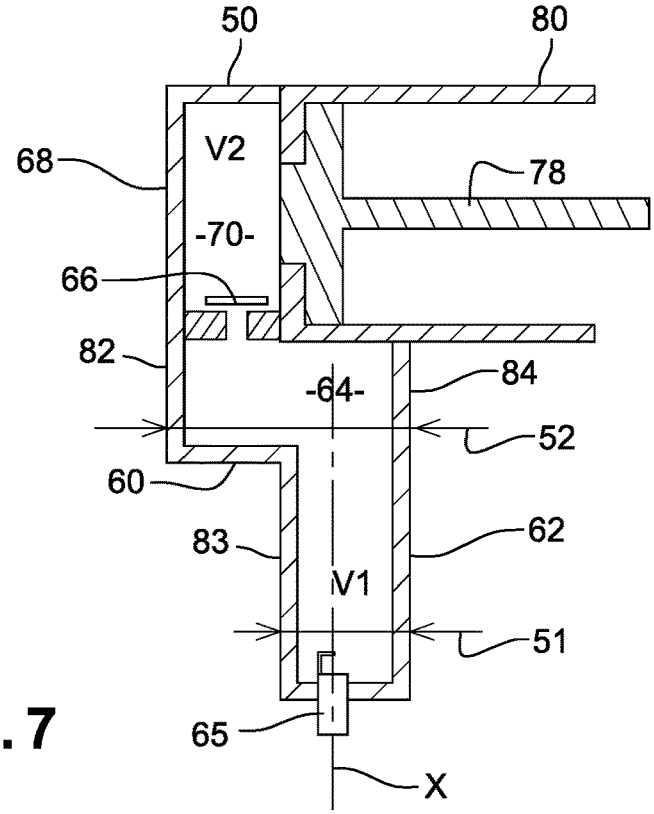

FIG. 7 shows a variant embodiment of the precombustion chamber 60. This figure shows a precombustion chamber 60 that includes a portion having a component of forward horizontal extension such that the shortest fluid flow line between the spark plug 65 and the connection to the combustion chamber 50 has (at least in part), from the sparkplug, a horizontal component inclined toward the rear of the tool.

This configuration leads to improved ergonomics because it is more beneficial in terms of the balance of the tool. With this design, the precombustion chamber is no longer situated entirely on one side of the tool and so the combustion chamber and the working chamber 80 do not necessarily form a conventional L-shaped architecture, i.e. a tool resembling a "pistol".

This new configuration is more practical in terms of ergonomics given that the masses of the working chamber and of the magazine containing the fixing elements are no longer all situated on the same side of the tool and on the same side of the handle of the tool.

The precombustion chamber 60 preferably includes at least two portions; the first of these portions is that connected to the combustion chamber 50 and the second portion is that farthest from the combustion chamber 50. The lateral wall 82 of the precombustion chamber 60 in the first portion is nearer the rear end of the tool than the lateral wall of the precombustion chamber in the second portion. The second portion preferably includes the sparkplug 65. The tool is configured so that the tool fits closely around the precombustion chamber.

At least one diameter, and preferably both diameters of the first and the second portion, is or are preferably constant. For example, as shown in FIG. 7, the elongate chamber of constant cross section is replaced by two portions of which an upper one has a cross section S2 larger than that S1 of the other, lower one. The chamber 60 therefore has in longitudinal section the general shape of an L. Consequently, whilst maintaining the volume V1 constant, this embodiment has a length less than the length B of the prior art. Consequently, the overall size of the tool can be reduced.

As seen in FIG. 7, in one embodiment of the present disclosure the precombustion chamber 60 is no longer rectilinear, but comprises a curvature in order to shift the handle of the tool (which contains the precombustion chamber) closer to the center of gravity of the tool. In the example shown, a horizontal portion is present. The (left-hand) lateral wall 83 of the precombustion chamber in the portion with the sparkplug is positioned nearer the (right-hand) lateral wall 84 of the portion connected to the combustion chamber.

Whilst maintaining V1 constant relative to the prior art, the present disclosure makes it possible to maintain a comparable or even identical level of performance, in terms of production of energy, in a tool that is much better balanced.

Combustion Chamber

As shown in FIG. 5, the combustion chamber 50 of a tool is generally adjacent the working chamber 80 in which the piston 78 is moved by the effect of the combustion of the air-fuel mixture.

Consequently, as the casing of the working chamber 80 still has a cylindrical shape and the piston 78 also has a cylindrical shape, the combustion chamber 50 has a cylindrical general shape at the end adjoining the working chamber 80.

As seen in FIG. 5, this combustion chamber 50 has the shape of a flat cylinder having a diameter D and a height H and its cavity 70 has a volume V2.

The inventors have found that this chamber 50 does not yield an optimum output of energy. They have found an improved shape for the combustion chamber that makes it possible to improve the production of energy.

Figure 8:
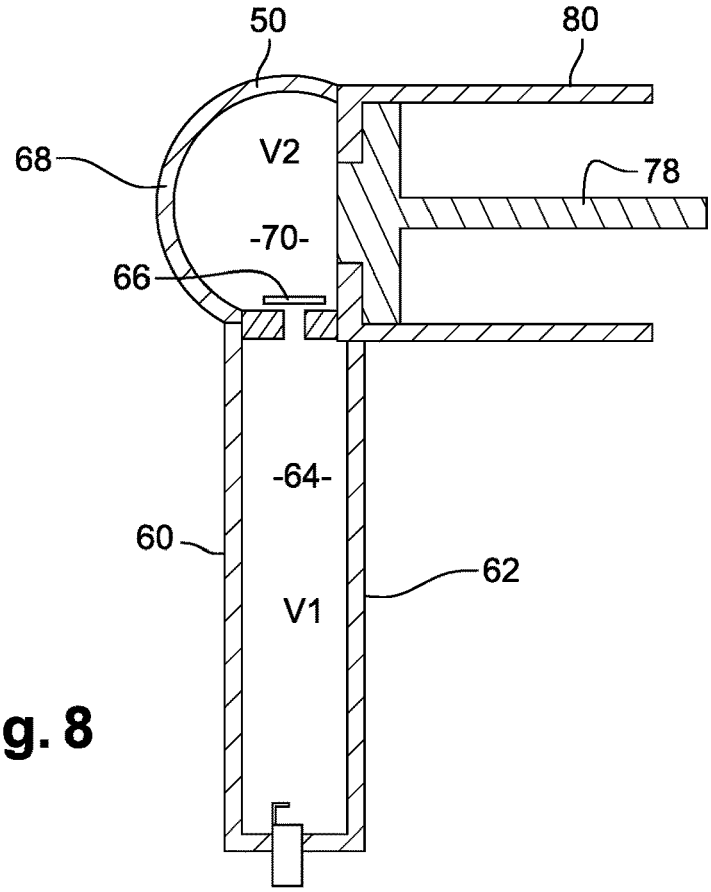

A preferred embodiment is shown in FIG. 8 in which the combustion chamber defines a spherical or oval combustion cavity.

This spherical/oval shape leads to improved mixing and to correct distribution of fuel and purging of the combustion gases. In actual fact, the inventors have discovered that this shape features no dead areas caused by the presence of edges in the cavity. These edges affect both the flow and the combustion flame. The flow tends to stop on approaching the edges, resulting in dead areas. The flame is also affected by these edges because it tends to be extinguished on approaching the edges. The new shape eliminates most if not all of the harmful dead points that exist in the prior art. Even if the combustion volume is not a perfect sphere, any edge that can be removed from the volume of the combustion chamber makes it possible to optimize the entry and exit flows into and out of the chamber for optimum feeding with the air-fuel mixture and optimum scavenging of the combustion gases.

Moreover, the mixture can burn much more efficiently in any area of the combustion chamber, minimizing the dead areas. As the main reason for this improvement is the elimination of edges and dead corners, a partially spherical shape may also be replaced by a partially oval shape or any other shape that has no or a minimum number of edges, for example a shape in which the radius of curvature of the upper portion of the bottom wall (here on the left) of the combustion chamber 50 is 25%, preferably 50%, greater than the smallest diameter of the prior art combustion chamber (for example, H).

Figure 9A:
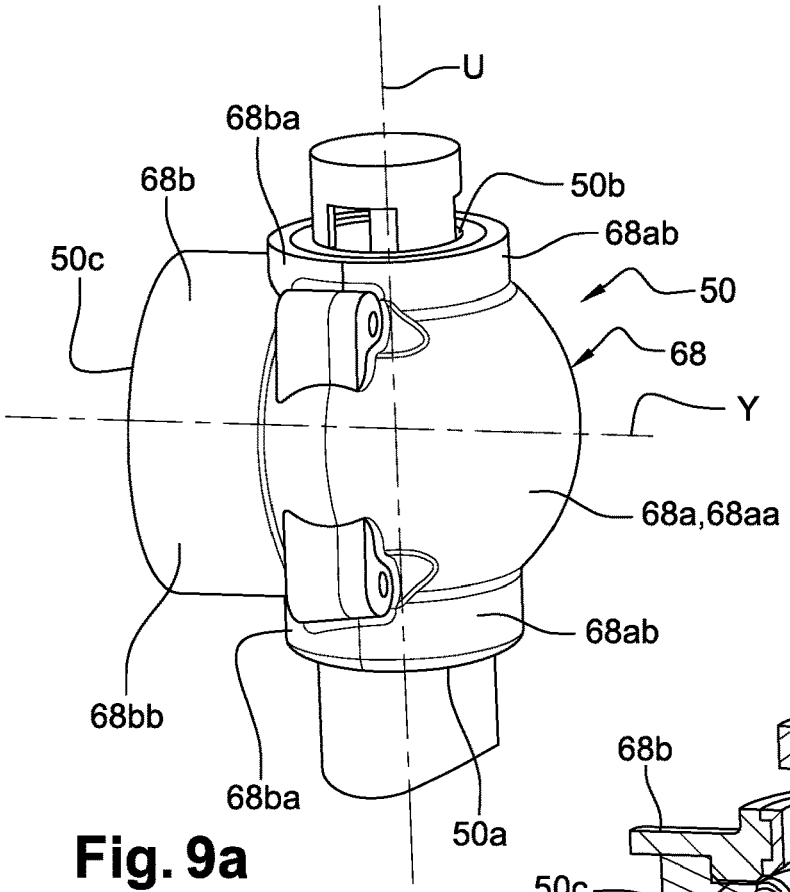
FIGS. 9*a*, 9*b*, and 9*c* are diagrammatic views in perspective and/or in axial section of a combustion chamber in accordance with one example embodiment of the present disclosure.
Figure 9B:
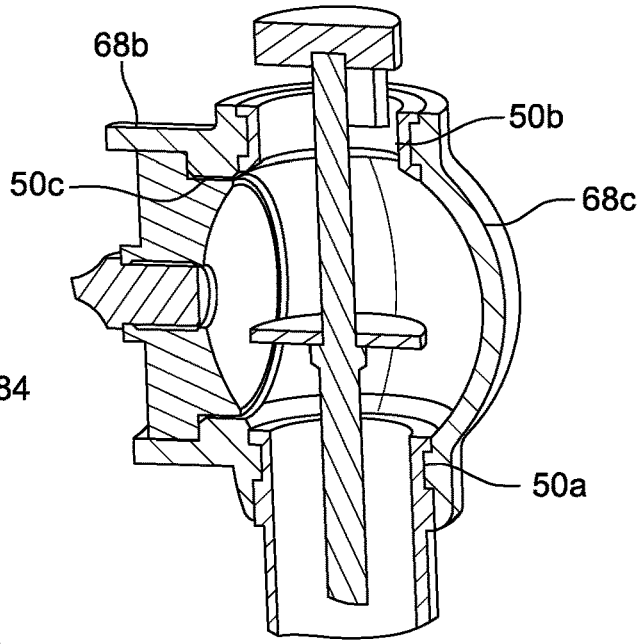
Figure 9C:
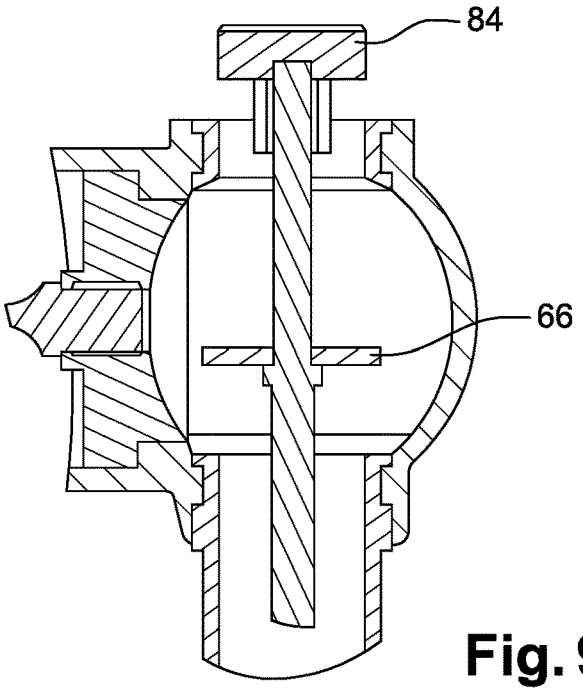

FIGS. 9*a* to 9*c* show a more concrete embodiment of this aspect of the present disclosure.

The combustion chamber 50 includes a casing 68 defining three openings, of which two openings 50*a*, 50*b* are aligned on the same axis U, which corresponds to the longitudinal axis of the precombustion chamber or a portion thereof, and a third opening 50*c* is aligned on an axis Y substantially perpendicular to the axis U.

The casing 68 includes a first half-shell 68*a* including a part-spherical first wall 68*aa*. This first wall 68*aa* is a median wall that is situated between two end walls 68*ab* each of which is a part-cylinder. The end walls 68*ab* define in part the openings 50*a*, 50*b* with axis U. The casing 68 includes a second half-shell 68*b* including two end walls 68*bb* each of which is a part-cylinder and defining the rest of the openings with axis U and a cylindrical wall 68*ba* defining the opening on the axis Y.

The opening 50*a* provides fluid communication with the cavity of the precombustion chamber. The opening 50*c* provides fluid communication with the internal cavity of the working chamber, and the opening 50*b* provides fluid communication with the atmosphere. The opening 50*a* can be shut off by the aforementioned valve 66 and the opening 50*b* can be shut off by a valve 84 the mobile body of which is carried by a rod also carrying the valve 66.

Working Chamber

The performance of a combustion-actuated fixing tool is notably based on the capacity of the piston to convert efficiently the pressure energy generated by the combustion of the explosive mixture into kinetic energy transferred to the fixing element. This efficient conversion is affected by the leaks that occur between the piston and the casing of the working chamber. These pistons and the casings are very well known because these are used in all the tools. The design of the combustion chamber and the combustion technology may vary from one tool to another, but the piston reciprocating in the casing remains essentially the same for the various fixing tools.

This is well known to the person skilled in the art, as explained in the document EP-B1-123 717. Combustion occurs and the pressure generated moves the piston to drive the fixing element into a support material. Slightly before the piston reaches the bottom or the end of its driving travel, where it comes to abut against an elastic shock absorber, the piston passes ports in the wall of the casing that serve to evacuate the combustion gases. These ports make it possible to facilitate the elimination of the combustion gases to facilitate the establishing of a partial vacuum so that air at atmospheric pressure can penetrate under the piston and facilitate the return of the latter into its rest or upper position.

The piston used in such a tool conventionally includes dynamic sealing mechanism, that is to say mechanisms used to provide a seal between the piston and the casing of the working chamber during the movement of the piston over its travel. This travel results from a pressure difference between the two sides of the piston (combustion for driving and vacuum for return). The seals in accordance with the prior art are configured to provide a dynamic seal.

The presence of a precombustion chamber makes it possible to increase the efficiency of combustion and to increase the pressure inside the tool.

In its initial retracted position, the piston must be sealed firstly to contain the pressure generated by the combustion of the air-fuel mixture. As mentioned above, the seal must be maintained and the combustion chamber must not leak each time that the mixture is boosted or in the presence of the pre-pressure generated by the precombustion chamber before ignition in the combustion chamber when the combustion technology employs a precombustion chamber. During this preliminary phase, the piston must therefore be sealed as perfectly as possible. Ideally, the piston must also remain stable to maintain the small volume of the combustion chamber in order to maximize the pressure until combustion is almost complete. Ideally, in this preliminary phase, the piston must also be retained until a pressure peak occurs and combustion finishes. This requirement to retain the piston during a preliminary phase has been addressed in the prior art by employing magnets or mechanisms, notably balls, springs and/or cams. All these piston retaining mechanisms are generally bulky, complex and costly.

Consequently, in this preliminary phase, the requirement is to provide a maximum seal between the piston and the casing of the working chamber and therefore to have a maximum static seal when the piston is in the rest position.

Ideally, the piston must be retained in this position, in a sealed manner, until the pressure peak is reached, in order to maximize the transformation of energy in the form of combustion pressure to kinetic energy driving the piston.

Releasing the piston is the second stage of the operation, in which the piston accelerates along its travel until it reaches its opposite working position and drives the fixing element into the support material. During this second stage, the requirement for a seal between the piston and the casing is less problematic. The dynamic sealing mechanisms are severely stressed by the acceleration of the piston and rubbing against the casing but provide a satisfactory response to this requirement.

There is therefore a compromise in respect of the sealing mechanism between the first phase demanding static sealing performance and the second phase demanding dynamic sealing performance.

The person skilled in the art generally considers that static seals are generally flexible seals (O-rings, etc.) made of flexible materials such as rubber, silicone, etc. These are effective if there is no relative movement between the parts or if the movements are limited and slow. The same person skilled in the art knows that dynamic seals are more capable of providing a seal between two parts in motion, even if the seal as such is not as good with a static seal.

For internal combustion engines, the dynamic seals for pistons may be piston rings made of metals such as steel, which function efficiently at high speed and at high temperature. Other dynamic seals also exist, such as lip seals or composite seals, for example, although they are not generally as effective as steel seals because of the high temperatures encountered in internal combustion engines.

This confirms the compromise mentioned above between the static seal required in the first phase of operation of the tool and the dynamic seal required in the second phase. This compromise is further justified by the particular structure of the fixing tools, which have one or more exhaust ports situated inside the casing of the working chamber, between the two extreme positions of the travel of the piston. These exhaust ports are responsible for evacuating the burned gases. Unfortunately, when the piston passes these exhaust ports, the dynamic sealing mechanisms are strongly compressed and tend to expand into the open exhaust port. This situation is relatively well tolerated by steel seals but not by flexible seals. Flexible seals therefore tend to wear rapidly if they are exposed to repeated passages at the level of the exhaust ports because they tend to be extruded into the exhaust ports.

The inventors have sought to provide an improved seal between the piston and its casing when the piston is in its rest position, this seal not being degraded by the passage of the piston at the level of the exhaust ports. Ideally, these improved sealing mechanisms should retain the piston in its rest position until the pressure of the combustion gases in the chamber reaches a certain threshold.

In accordance with the present disclosure, the working chamber includes a casing, for example a cylindrical casing, a piston and a first seal to seal the piston in the retracted or rest position of the piston (static seal) and a second seal—that is different from the first seal—to seal the piston during its movement (dynamic seal).

Using two different seals, each seal may be optimally adapted to the necessary sealing function and no compromise has to be found between a dynamic seal and a static seal.

The second seal is preferably fixed to the piston (for example housed in a groove in the piston). The first seal and the second seal are preferably both fixed to the piston and the casing preferably has a sealing surface for the first seal that is radially inside the sealing surface for the second seal. For example, the casing therefore includes a radial projection towards the interior of the interior cylindrical surface opposite the first seal before/in the rest position. More preferably, the first seal is fixed to the casing (for example housed in a groove in the casing). In this case, there is preferably no radially inward projection present that holds the seal or serves as a radial sealing surface (for example in the form of a cylindrical lateral surface).

In attempting to solve the problems and address the compromises listed above, the inventors have produced a number of embodiments that are shown in FIGS. 10*a* to 10*e*.

All the embodiments show a working chamber 80 including a casing 90 in which a piston 78 is slidably mounted, the internal cavity 92 of the working chamber communicating with the internal cavity of a combustion chamber as described above.

The piston 78 is represented in its retracted or rest position, as known in the prior art and already explained above, and moves (downward in the orientation of the figures) in the casing 90 to drive in a fixing element. During its travel, the piston may eventually pass an exhaust port 94.

Figure 10A:
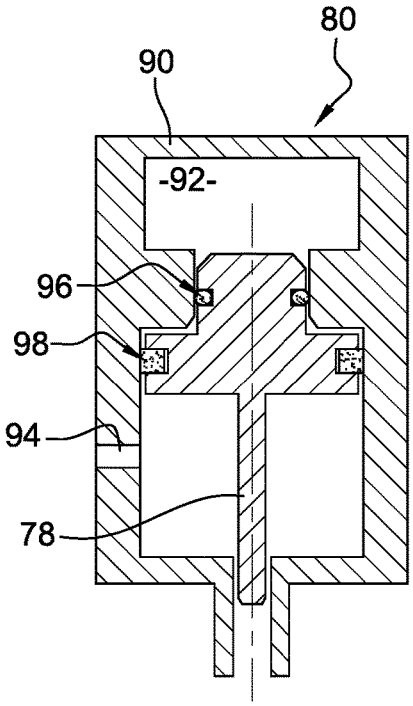
FIGS. 10*a*, 10*b*, 10*c*, 10*d*, and 10*e* are diagrammatic views in axial section of a working chamber in accordance with one example embodiment of the present disclosure.

FIG. 10*a* refers to the first embodiment of the present disclosure. The piston 78 includes a static seal 96 used to seal the piston in the preliminary phase of actuation of the tool. In this embodiment, the static seal 96 is carried by the piston and housed in a groove in the piston. The piston also includes a dynamic seal 98 housed in a groove in the piston.

Each seal provides the performance described above. The piston is configured so that the sealing surfaces for the seals are different. In this example, the diameter of the sealing surface for the static seal 96 is smaller than the diameter of the sealing surface for the dynamic seal 98. When the piston moves downwards, the dynamic seal remains in contact with its sealing surface throughout its travel. As the dynamic seal is able to resist repeated passages at the level of the exhaust port 94, there is no problem in respect of the durability of this seal. At the same time, while the piston is moving (downwards) along its travel, the static seal 96 provides the seal at the start of its travel, until it disengages from its smaller diameter sealing surface in the casing 90. Consequently, when the piston continues its travel, the static seal is no longer in contact with its surface or with any other surface of the casing.

In particular, thanks to this configuration, the static seal 96 is never in contact with the exhaust port 94 and therefore little loaded by friction. This static seal consequently provides a seal only during the first phase of the operation. This situation makes it possible to use the static seal as efficiently as possible without requiring any compromise because it is no longer exposed to dynamic loads.

The static seal may be made of flexible material, such as rubber, because it will never be in contact with the exhaust port 94 and will therefore never be damaged by friction. Moreover, the static seal may be a tight fit so that the seal is optimized. The other advantage of this tight fit is that the static seal participates in retaining the piston in its rest position. The static seal therefore acts also as a mechanism retaining the piston in accordance with the optimum combustion performance requirements.

Figure 10B:
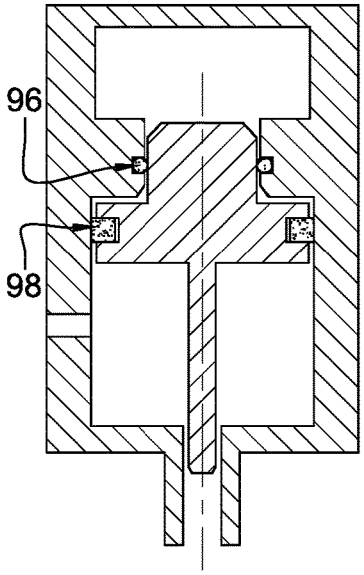

Referring now to FIG. 10*b*, the general advantages described above remain applicable except that the groove for retaining the static seal 96 is situated on the surface of the casing that must be sealed. FIGS. 10*a* and 10*b* represent two solutions to achieve the same effects of sealing and retaining the piston.

Figure 10C:
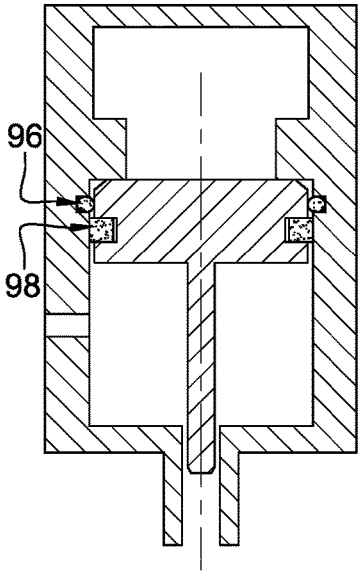

FIG. 10*c* is another embodiment of the present disclosure. It represents a simplification of the structure. The static seal 96 is held in place in a groove in the casing of the tool and not in the piston. There is no necessity for the sealing surfaces of the seals to be different. As the static seal does not follow the piston along its travel, there is no risk of the static seal encountering the exhaust port, even if the surfaces of the seals are the same. In other words, the diameter of the surface of the static and dynamic seals may be identical and the piston 78 may be designed with only one diameter. Consequently, this simplified embodiment also procures all the advantages of the present disclosure in respect of the static seal, the dynamic seal and the retention of the piston in its rest position.

Figure 10D:
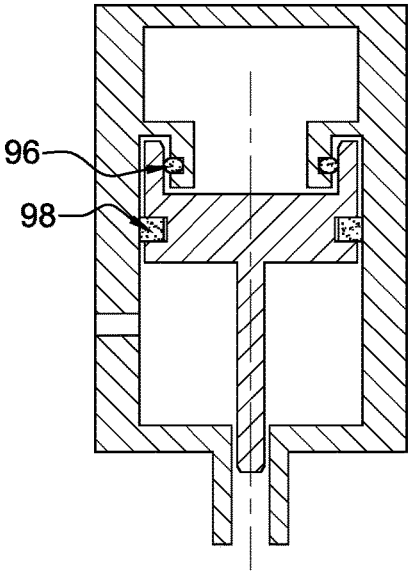
Figure 10E:
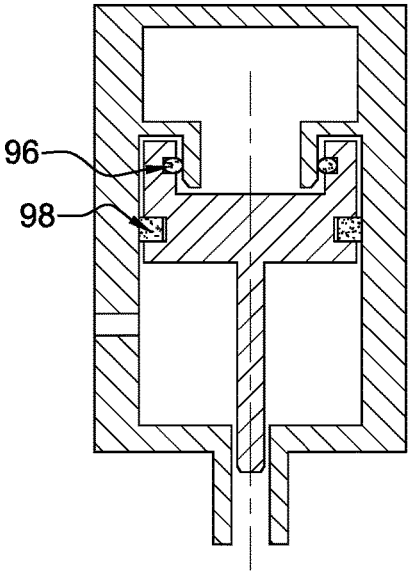

FIGS. 10*d* and 10*e* are other embodiments of the invention. They are in fact another design of the embodiments from FIGS. 10*a* and 10*b*. The piston utilizes two different sealing surfaces for the static seal and the dynamic seal. The difference being that in FIGS. 10*a* and 10*b* the piston is the male part of the sealing surface of the static seal whereas in FIGS. 10*d* and 10*e* the piston is the female part of the sealing surface of the static seal. Once again, the advantages of the present disclosure are the static seal, the dynamic seal and the retention of the piston in its rest position.

In the various embodiments, the piston 78 has an elongate shape and comprises a head and a rod that are coaxial. The static seal 96 is situated in an area of the piston head near a longitudinal end thereof that is opposite the rod.

The invention claimed is:

1. A precombustion chamber for a gas-powered fixing tool, the precombustion chamber comprising: a casing defining an outlet and a combustion cavity having an elongate form and having a longitudinal axis X configured to be transverse to a direction of movement of a piston of the gas-powered fixing tool, the combustion cavity having a variable cross section along the longitudinal axis X, wherein a first portion of the casing defines a first portion of the combustion cavity having a first cross section along the longitudinal axis X, wherein a second portion of the casing defines a second portion of the combustion cavity having a second cross section along the longitudinal axis X that is greater than the first cross section, the first portion of the casing defining an opening configured to receive an ignition mechanism, and wherein the second portion of the casing defines the outlet such that the outlet is configured to be adjacent to a combustion chamber of the gas-powered fixing tool.

2. The precombustion chamber of claim 1, wherein the combustion cavity has a staged form.

3. The precombustion chamber of claim 2, wherein the ignition mechanism is situated at a longitudinal end of the combustion cavity.

4. The precombustion chamber of claim 1, wherein the casing defines the outlet on a longitudinal end opposite the ignition mechanism, which is fluidically connected with a second combustion cavity.

5. The precombustion chamber of claim 4, wherein the first portion of the combustion cavity extends along the longitudinal axis X, and the second portion of the combustion cavity extends from one end of the first portion of the combustion cavity in a direction perpendicular to the longitudinal axis X.

6. The precombustion chamber of claim 4, wherein the first portion of the combustion cavity extends along the longitudinal axis X, and the second portion of the combustion cavity extends from one end of the first portion of the combustion cavity in a first direction perpendicular to the longitudinal axis X and in a second opposite direction.

7. A gas-powered fixing tool comprising:

a combustion chamber;

an ignition mechanism;

a piston; and a precombustion chamber comprising a casing defining an outlet and a combustion cavity having an elongate form and having a longitudinal axis X transverse to a direction of movement of the piston, the combustion cavity having a variable cross section along the longitudinal axis X, wherein a first portion of the casing defines a first portion of the combustion cavity having a first cross section along the longitudinal axis X, wherein a second portion of the casing defines a second portion of the combustion cavity having a second cross section along the longitudinal axis X that is greater than the first cross section, the first portion of the casing defining an opening in which the ignition mechanism is positioned, and wherein the second portion of the casing defines the outlet adjacent to the combustion chamber.

8. The gas-powered fixing tool of claim 7, wherein the combustion cavity has a staged form.

9. The gas-powered fixing tool of claim 8, wherein the ignition mechanism is situated at a longitudinal end of the combustion cavity.

10. The gas-powered fixing tool of claim 7, wherein the casing defines the outlet on a longitudinal end opposite the ignition mechanism, which is fluidically connected with a second combustion cavity.

11. The gas-powered fixing tool of claim 10, wherein the first portion of the combustion cavity extends along the longitudinal axis X, and the second portion of the combustion cavity extends from one end of the first portion of the combustion cavity in a direction perpendicular to the longitudinal axis X.

12. The gas-powered fixing tool of claim 10, wherein the first portion of the combustion cavity extends along the longitudinal axis X, and the second portion of the combustion cavity extends from one end of the first portion of the combustion cavity in a first direction perpendicular to the longitudinal axis X and in a second opposite direction.

* * * * *